US006219879B1

(12) United States Patent
Oyaizu et al.

(10) Patent No.: US 6,219,879 B1
(45) Date of Patent: Apr. 24, 2001

(54) CYLINDER CLEANING DEVICE

(75) Inventors: Hideo Oyaizu, Tokyo; Shigeo Isobe, Iwatuki; Shigeo Yamamoto, Chiba; Takayuki Goto, Yamakawa-machi, all of (JP)

(73) Assignee: Baldwin-Japan, Ltd., Tokyo (JP)

( * ) Notice: Subject to any disclaimer, the term of this patent is extended or adjusted under 35 U.S.C. 154(b) by 0 days.

(21) Appl. No.: 09/245,031

(22) Filed: Feb. 5, 1999

Related U.S. Application Data

(62) Division of application No. 08/883,063, filed on Jun. 26, 1997, now Pat. No. 6,041,711.

(30) Foreign Application Priority Data

| | | |
|---|---|---|
| Jun. 27, 1996 | (JP) | 8-186797 |
| Feb. 19, 1997 | (JP) | 9-79069 |
| Mar. 19, 1997 | (JP) | 9-86142 |

(51) Int. Cl.[7] ..... B41F 35/00; B41L 41/00
(52) U.S. Cl. ..... 15/256.51; 101/425
(58) Field of Search ..... 15/256.51, 256.5; 101/425

(56) References Cited

U.S. PATENT DOCUMENTS

| | | |
|---|---|---|
| 4,058,059 | 11/1977 | Moestue . |
| 4,986,182 | 1/1991 | Sawaguchi et al. . |
| 5,150,653 | 9/1992 | Hara . |
| 5,176,080 | 1/1993 | Gasparrini . |
| 5,390,602 | 2/1995 | Gorl . |
| 5,509,353 | 4/1996 | Aoki . |

FOREIGN PATENT DOCUMENTS

| | | |
|---|---|---|
| 2501319 | 7/1976 | (CH) . |
| 2538105 | 4/1976 | (DE) . |
| 2817614 | 11/1978 | (DE) . |
| 3417130 | 11/1985 | (DE) . |
| 3841260 | 3/1990 | (DE) . |
| 9005088 | 7/1990 | (DE) . |
| 0479403 A2 | 4/1992 | (EP) . |
| 0529764 | 3/1993 | (EP) . |
| 0539771 A1 | 5/1993 | (EP) . |
| 1149396 | 4/1969 | (GB) . |
| 08142316 | 6/1996 | (JP) . |

OTHER PUBLICATIONS

Patent Abstracts of Japan, vol. 96, No. 10, Oct. 31, 1996 (translated abstract and English Statement of JP 08142316.

*Primary Examiner*—Randall E. Chin
(74) *Attorney, Agent, or Firm*—Morgan & Finnegan, LLP

(57) ABSTRACT

According to the invention, there is provided a cylinder cleaning device for use with a cleaning fabric supply roll having a cleaning fabric wound thereon. The cleaning fabric is supplied from the supply roll and pressed against the outer surface of a cylinder to clean the outer surface of the cylinder. The device comprises a frame and a roll receiver mounted on the frame. The outer surface of the supply roll is engaged with and received by the receiver. The device further a comprises a roll stabilizer for stabilizing the supply roll on the receiver when the supply roll is rotated on the receiver to supply the cleaning fabric and have a diameter correspondingly decreasing.

16 Claims, 20 Drawing Sheets

CYLINDER CLEANING DEVICE

This is a divisional of application Ser. No. 08/883,063 filed Jun. 26, 1997, now U.S. Pat. No. 6,041,711, which is herein incorporated by reference.

BACKGROUND OF THE INVENTION

1. Field of the Invention

The invention relates to a cylinder cleaning device for cleaning the outer surface of a cylinder in an offset printing press, such as a blanket cylinder, an impression cylinder, a plate cylinder, or an inking cylinder. More particularly, the invention relates to a cylinder cleaning device for use with a cleaning fabric supply roll having a cleaning fabric wound thereon, the cleaning fabric being supplied from the supply roll and pressed against the outer surface of the cylinder to clean the outer surface of the cylinder.

2. Description of Related Art

In a cylinder cleaning device for cleaning the outer surface of a cylinder in an offset printing press, such as a blanket cylinder, there has been generally used a cleaning fabric supply roll having a core about which a cleaning fabric is wound. The device further includes a rigid metal shaft fitted into the core. The shaft is mounted at opposite ends on a frame in the device to support the supply roll for rotation so that the cleaning fabric can be supplied from the supply roll and pressed against the outer surface of the cylinder to clean the outer surface. However, since the shaft is long and heavy, it is troublesome to insert and fit the shaft into the core and then mount the shaft on the frame. Labour and time are required. In addition, a certain device can use only the supply roll having the core which is adapted to fit the shaft of the device, the supply roll and the core being limited in size. Not every supply roll can be used.

There has been also proposed a cylinder cleaning device as disclosed in Japanese Laid-Open Patent Publication No. 234,659 of 1992, in which the the core is directly mounted and held at opposite ends on the frame to support the supply roll for rotation without using the metal shaft. However, in the device, the supply roll has merely a poor rigidness due to lack of the shaft. Accordingly, the center of supply roll may deflect so that the cleaning fabric can not be uniformly supplied. In addition, the core and the supply roll may be disengaged from the frame to fall off. A certain device can use only the supply roll having the core which is adapted to be mounted and held on the frame, the supply roll and the core being limited in size.

In order to overcome the above problems, an attempt has been made to provide a cylinder cleaning device in which the outer surface of the supply roll is engaged with and received by a cross beam to support the supply roll for rotation, the cross beam being mounted on the frame in the device. However, the supply roll can not be stabilized on the cross beam by merely engaging the outer surface of the supply roll with the cross beam. The supply roll may vibratingly move along the cross beam and bounce from the cross beam when the the supply roll is rotated on the cross beam to supply the cleaning fabric. The cleaning fabric can not therefore be uniformly supplied.

By the way, the cleaning fabric may have one surface made of pulp which is intended to be bought into contact with the outer surface of the cylinder for cleaning, and the other surface made of polyester fibers for reinforcing the cleaning fabric. Under these circumferences, it is required to properly set up the supply roll in the device to conveniently supply the cleaning fabric from the supply roll so that not the other surface but the one surface of the cleaning fabric is bought into contact with the outer surface of the cylinder. If an operator conversely positions the opposite ends of the supply roll by mistake when set up, the cleaning fabric will be directed from the supply roll so that the other surface is bought into contact with the outer surface of the cylinder. This has a problem that the polyester fibers adhere to the outer surface of the cylinder to lower the quality of printed product.

It is therefore an object of the invention to provide a new and improved cylinder cleaning device, in which the above problems can be overcome.

Another object of the invention is to provide a cylinder cleaning device in which it is easy to set up the supply roll in the device without labor and time.

Other object of the invention is to provide a cylinder cleaning device in which any supply roll can be used irrespectively of the size of the supply roll and the core.

Other object of the invention is to provide a cylinder cleaning device in which a supply roll can be used even if it has no core.

Other object of the invention is to provide a cylinder cleaning device in which the supply roll is stabilized when rotated so that the cleaning fabric can be uniformly supplied from the supply roll.

Other object of the invention is to provide a cylinder cleaning device which is intended to properly set up the supply roll to conveniently supply the cleaning fabric from the supply roll.

Other object of the invention is to provide a cleaning fabric supply roll for preventing the operator from conversely positioning the opposite ends of the supply roll by mistake when set up.

SUMMARY OF THE INVENTION

According to the invention, there is provided a cylinder cleaning device for use with a cleaning fabric supply roll having a cleaning fabric wound thereon. The cleaning fabric is supplied from the supply roll and pressed against the outer surface of a cylinder to clean the outer surface of the cylinder.

The device comprises frame means and roll receiving means mounted on the frame means. The outer surface of the supply roll is engaged with and received by the receiving means. The device further comprises roll stabilizing means for stabilizing the supply roll on the receiving means when the supply roll is rotated on the receiving means to supply the cleaning fabric and have a diameter correspondingly decreasing.

In a preferred embodiment, the supply roll has a core about which the cleaning fabric is wound. The stabilizing means comprises guide means for guiding the core for movement toward the receiving means in accordance with the decrease in diameter of the supply roll to stabilize the supply roll on the receiving means.

The receiving means may comprise a cross beam mounted on the frame means. The outer surface of the supply roll is engaged with and received by the cross beam to support the supply roll for rotation. The stabilizing means comprises guide means for guiding the core for movement toward the cross beam in accordance with the decrease in diameter of the supply roll, and movable member means opposed to the cross beam, engaged with the outer surface of the supply roll and moved toward the cross beam in accordance with the decrease in diameter of the supply roll.

In another embodiment, the stabilizing means further comprises resiliently urging means for resiliently urging the movable member means toward the receiving means. The supply roll is supported on the movable member means for rotation by the resiliently urging means.

In another embodiment, the supply roll is sandwiched between the movable member means and the cross beam. The movable member means, the guide means and the cross beam cooperate with each other to support the supply roll for rotation.

According to the invention, there is also provided a cleaning fabric supply roll having a cleaning fabric wound about a core to form an outer surface to be engaged and received. The supply roll comprises projections extending coaxially with the core and projecting from the opposite end surfaces of the supply roll respectively. The supply roll further comprises distinguishing means for distinguishing the projections from each other. The distinguishing means may comprise the projections which are different in length, color, diameter or material from each other.

In another embodiment, the outer surface of the supply roll is engaged with and received by the cross beam to support the supply roll for rotation. The stabilizing means is opposed to the cross beam and engaged with the outer surface of the supply roll to sandwich and stabilize the supply roll between the stabilizing means and the cross beam.

In another embodiment, the frame means comprises a pair of side frames. The cross beam is disposed between and mounted on the side frames. The outer surface of the supply roll is engaged with and received by the cross beam to support the supply roll for rotation, the stabilizing means being opposed to the cross beam, mounted on arm means and engaged with the outer surface of the supply roll. The arm means is supported at one end for swinging movement to move the stabilizing means toward the cross beam in accordance with the decrease in diameter of the supply roll. The arm means includes bar means mounted thereon and extending parallel to the cross beam. A passage is formed between the cross beam and the bar means so that the cleaning fabric is fed through the passage from the supply roll.

The stabilizing means may comprises a first elongated member supported on the arm means and a second elongated member disposed between the first elongated member and the bar means. The second elongated member is mounted on additional arm means supported on the bar means. The additional arm means is swingingly moved about the bar means toward the supply roll so that the second elongated member is engaged with the outer surface of the supply roll.

DETAILED DESCRIPTION OF THE PREFERRED EMBODIMENTS

Figure 1:
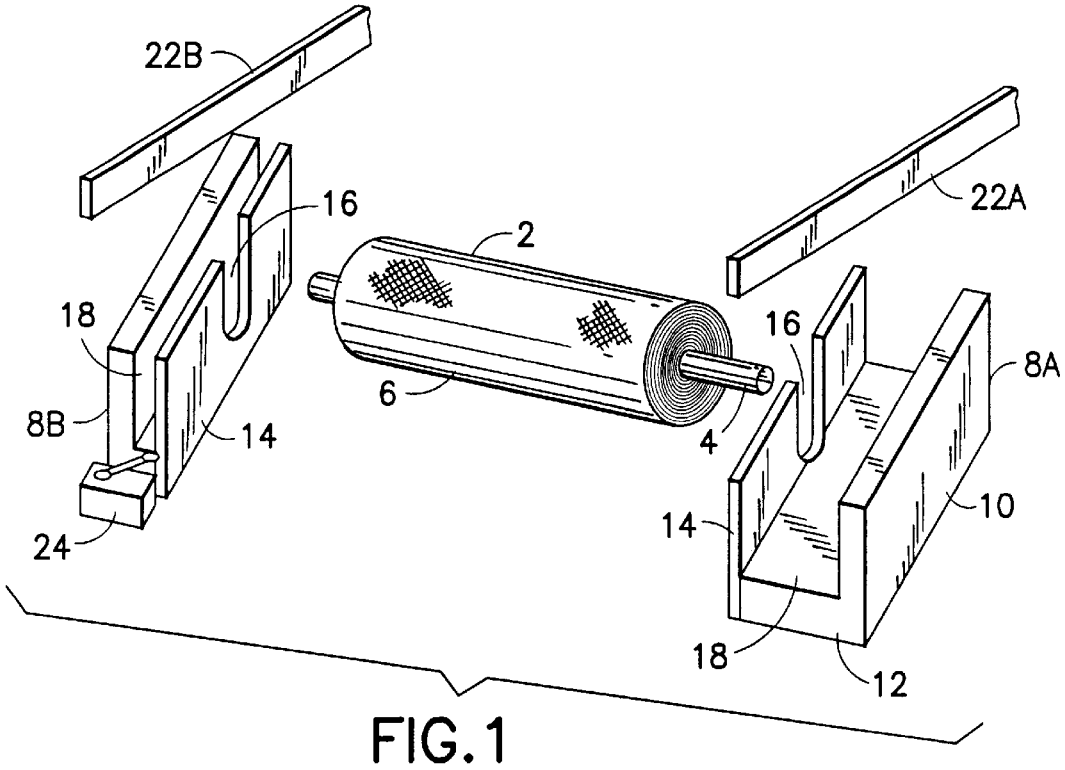
FIG. 1 is an explanatory view of a cleaning fabric supply roll according to the invention.

Referring to FIG. 1, a cleaning fabric supply roll 2 according to the invention is shown, which is used in a cylinder cleaning device. The device comprises frame means and roll receiving means mounted on the frame means. The outer surface of the supply roll 2 is engaged with and received by the receiving means.

The supply roll 2 has a core 4 about which a cleaning fabric 6 is wound. The core 4 may be hollow and tube-shaped. The core 4 may comprise a solid rod. The cleaning fabric 6 may be an ordinary fabric, a non-woven fabric, a paper, a plastic film or the like. In addition, the cleaning fabric 6 may be previously impregnated with a cleaning agent or detergent. The cleaning fabric may then packaged in a vacuum pack. The cleaning fabric may have a detergent in the form of jelly or paste applied onto the cleaning fabric.

The cleaning fabric 6 is supplied from the supply roll 2 and pressed against the outer surface of a cylinder to clean the outer surface of the cylinder. The device further comprises roll stabilizing means for stabilizing the supply roll 2 on the receiving means when the supply roll 2 is rotated on the receiving means to supply the cleaning fabric 6 and have a diameter correspondingly decreasing. In the embodiment, the stabilizing means comprises guide means for guiding the core 4 for movement toward the receiving means in accordance with the decrease in diameter of the supply roll 2 to stabilize the supply roll 2 on the receiving means.

The guide-means comprises first and second guide portions in the form of side blocks 8A and 8B mounted on the frame of the device. The side blocks 8A and 8B are L-shaped each including a vertical portion 10 and a horizontal portion 12. The side blocks 8A and 8B further include plates 14 in which slots 16 are formed respectively. The plates 14 are disposed parallel and opposite to each other and attached to the edges of the horizontal portions 12 to cooperate with the vertical portions 10 and the horizontal portions 12 to form channels 18. The plates 14 are spaced from each other at a distance corresponding to the length of the supply roll 2.

Figure 2:
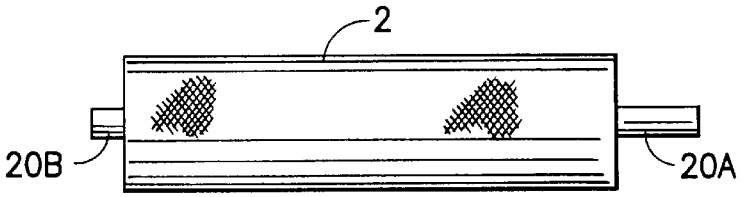
FIG. 2 is an elevational view of the supply roll of FIG. 1.

The stabilizing means further comprises projections extending coaxially with the core 4 and projecting from the opposite end surfaces of the supply roll 2 respectively. The projections comprise the extensions 20A and 20B of the core 4, as shown in FIG. 2. The projections 20A and 20B are inserted in the slots 16 and received in the channels 18 in the side blocks 8A and 8B for movement along the slots 16. The slots 16 extend toward the receiving means for guiding the core 4 for movement toward the receiving means. In addition, the supply roll 2 includes distinguishing means for distinguishing the projections 20A and 20B from each other. In the embodiment, the distinguishing means comprises the projections 20A and 20B which are different in length from each other. In this connection, the channels 18 are different in width from each other so that the operator has to set up the long projection 20A on the side block 8A and set up the short projection 20B on the side block 8B. The side block 8B is not capable of setting up the long projection 20A. This prevents the operator from conversely positioning the opposite ends of the supply roll 2 by mistake when set up the supply roll 2 in the device. The operator is obliged to properly set up the supply roll 2 in the device to conveniently supply the cleaning fabric 6 from the supply roll 2.

The stabilizing means further comprise a pair of movable members 22A and 22B which are inserted into the channels 18 and engaged with the projections 20A and 20B. The movable members 22A and 22B can be moved toward the receiving means in accordance with the decrease in diameter of the supply roll 2. Resiliently urging means such as a spring is provided for resiliently urging the movable members 22A and 22B toward the receiving means.

Accordingly, the projections 20A and 20B cooperate with the slots 16 to prevent the supply roll 2 from vibratingly moving along the receiving means. The projections 20A and 20B cooperate with the movable members 22A and 22B and the resiliently urging means to prevent the supply roll 2 from bouncing from the receiving means. The cleaning fabric 6 can therefore be uniformly supplied.

One of the side blocks 8B includes detecting means such as a switch 24. The movable member 22B extends to a position in which the switch 24 is disposed, to contact and activate the switch 24. Accordingly, the switch 24 is activated by the movement of the core 4 and the movable member 22B to detect the residual of the cleaning fabric 6 of the supply roll 2. The switch 24 generates a signal for electrical indication if the residual of the cleaning fabric 6 decreases to a small amount. In this connection, the projections 20A and 20B prevent the supply roll 2 from vibratingly moving along the receiving means and bouncing from the receiving means as described above, to precisely detect the residual of the cleaning fabric 6 of the supply roll 2 with no error signal from the switch 24.

Figure 3:
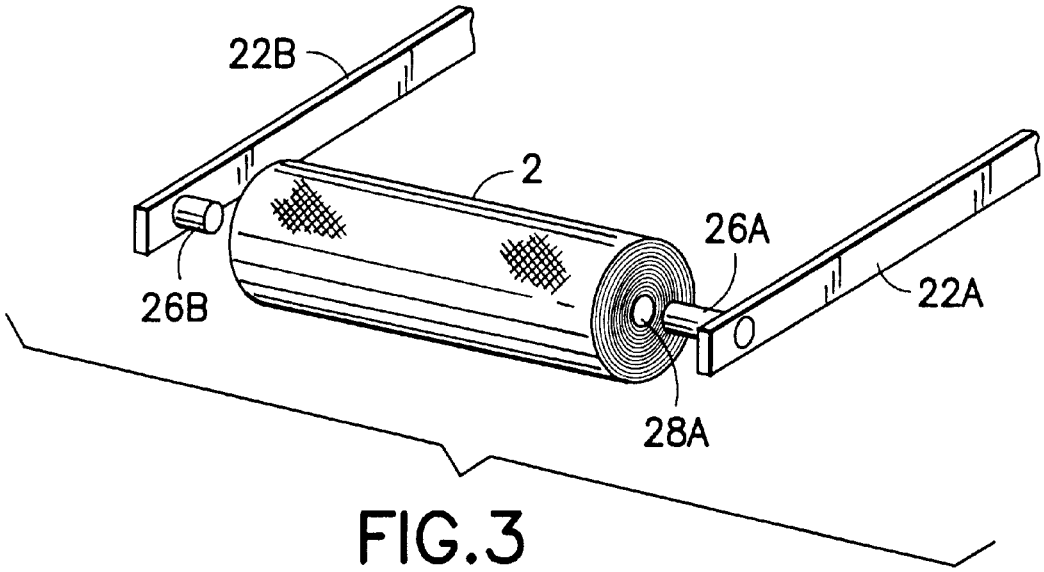
FIG. 3 is an explanatory view of another supply roll according to the invention.
Figure 4:
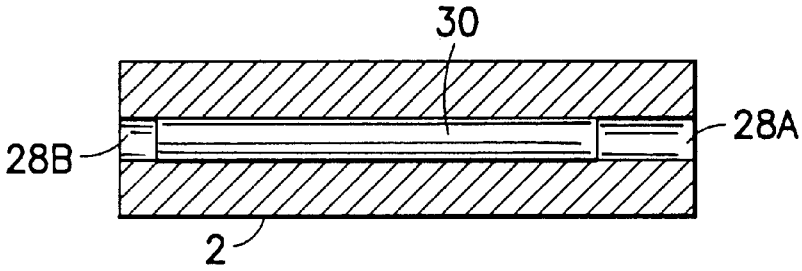
FIG. 4 is a sectional view of the supply roll of FIG. 3.
Figure 5:
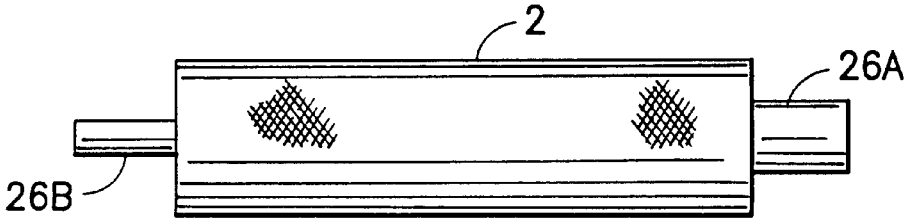
FIG. 5 is an elevetional view of another supply roll according to the invention.

The projections may comprise projecting members 26A and 26B fixed to the movable members 22A and 22B, as shown in FIG. 3. The supply roll 2 includes holes 28A and 28B formed in the opposite ends thereof, as shown in FIG. 4, the projections 26A and 26B being press fitted into the holes 28A and 28B and connected to the core 30. The projections 26A and 26B are different in length from each other, the holes 28A and 28B being different in length from each other so that the operator has to set up the long projection 26A in the long hole 28A and set up the short projection 26B in the short hole 28B. The short hole 28B is not capable of setting the long projection 26A. In other embodiments, the distinguishing means may comprise the projections which are different in color from each other. The projections may be partially or totally colored to be partially or totally different in color from each other. The distinguishing means may comprise the projections 26A and 26B which are different in diameter from each other as shown in FIG. 5, the holes being different in diameter from each other so that the operator has to set up the large projection 26A in the large hole and set up the small projection 26B in the small hole. The distinguishing means may comprise the projections which are different in material from each other. The projections may be connected to the core by screwing or glueing. The projections may comprise a member extending through the core.

Figure 6A:
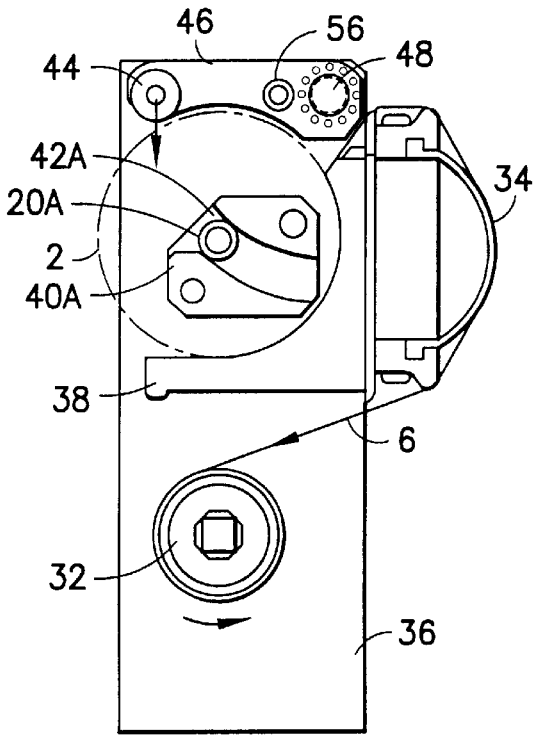
FIG. 6 is a side view of a preferred embodiment of the invention.

In a preferred embodiment of the invention shown in FIG. 6, the cleaning fabric 6 is directed from the supply roll 2 to a take up shaft 32 through a pressure pad 34. The take up shaft 32 is rotationally driven by drive means such as a motor or cylinder to take up the cleaning fabric 6 about the take up shaft 32 so that the cleaning fabric 6 is intermittently supplied from the supply roll 2 to the pressure pad 34. The cleaning fabric 6 is then pressed against the outer surface of the cylinder by the pressure pad 34 to clean the outer surface of the cylinder.

Figure 6B:
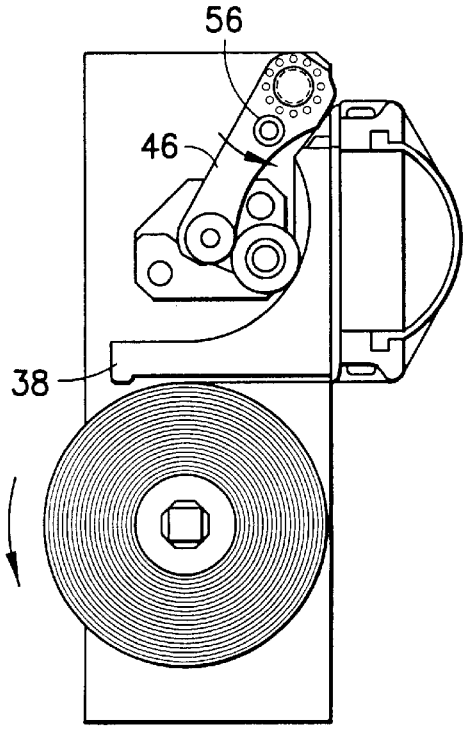
Figure 7:
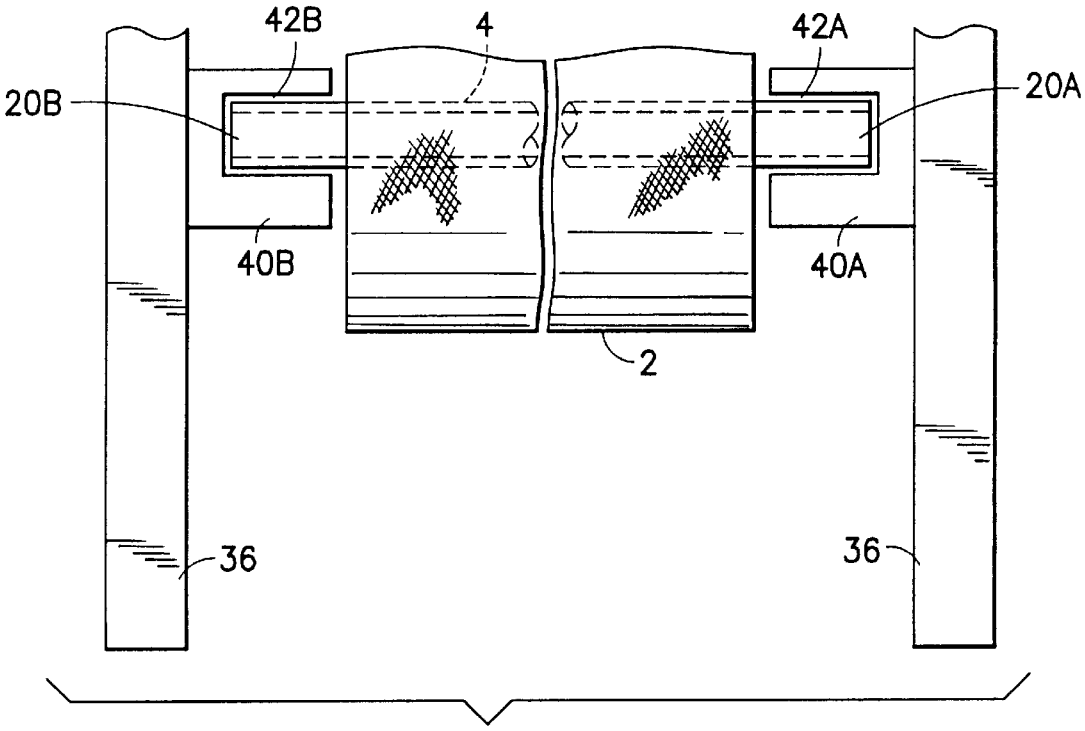
FIG. 7 is a plan view of the guide means of FIG. 6.

In the device in FIG. 6, the frame means comprises a pair of side frames 36. The outer surface of the supply roll 2 is engaged with and received by the receiving means which comprises a cross beam 38 disposed between and mounted on the side frames 36. The guide means comprises a pair of side blocks 40A and 40B mounted on the side frames 36, as shown in FIG. 7. The side blocks 40A and 40B each includes a slot 42A and 42B formed therein. The supply roll 2 includes the projections 20A and 20B comprising the extensions of the core 4 and inserted in the slots 42A and 42B. The slots 42A and 42B are different in depth from each other which correspond to the lengths of the projections 20A and 20B. The slots 42A and 42B extend toward the cross beam 38 for guiding the core 4 for movement toward the cross beam 38 in accordance with the decrease in diameter of the supply roll 2 to stabilize the supply roll 2 on the cross beam 38.

As to the cleaning fabric 6 wound on the supply roll 2 in the device in FIG. 6, the cleaning fabric 2 has an inner surface or one surface which is made of pulp and intended to be bought into contact with the outer surface of the cylinder for cleaning, and an outer surface or the other surface which is made of polyester for reinforcing the cleaning fabric 6. The operator is obliged to properly set up the supply roll 2 in the device to conveniently supply the cleaning fabric 6 from the supply roll 2 so that not the other surface but the one surface of the cleaning fabric 6 is bought into contact with the outer surface of the cylinder.

Figure 8:
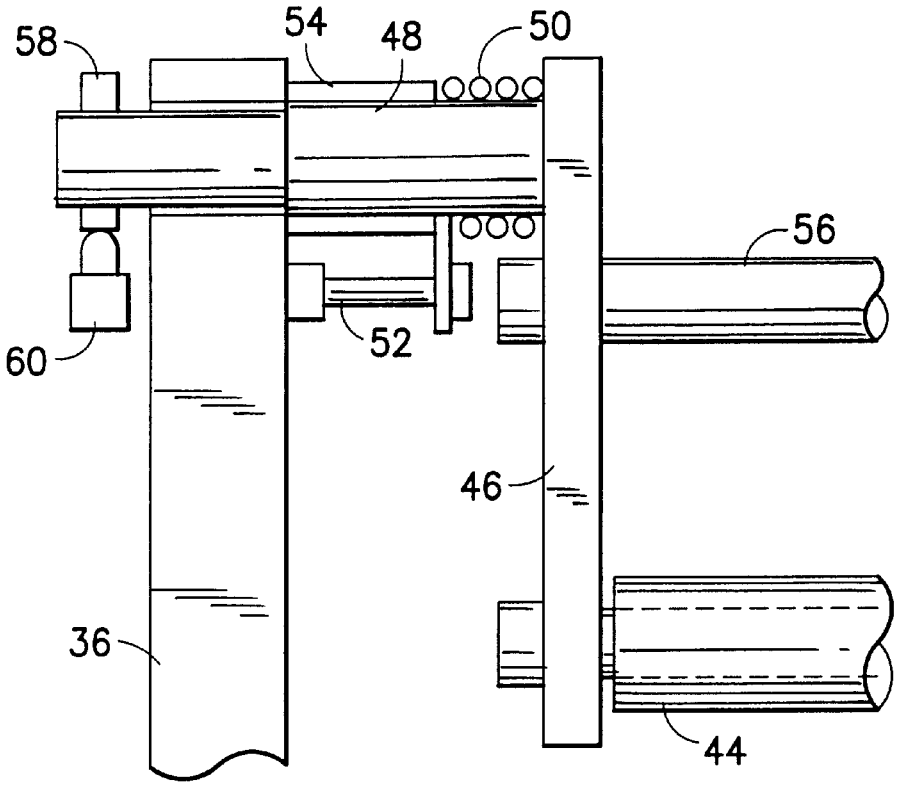
FIG. 8 is a plan view of the movable member of FIG. 6.

The device further includes movable member means which comprises a rotatable roller 44 opposed to the cross beam 38, mounted on a pair of arms 46 and engaged with the outer surface of the supply roll 2. The arms 46 are fixed to and supported on shafts 48 which are mounted on the side frames 36 for rotation, as shown in FIG. 8, so that the roller 44 and the arms 46 can be swingingly moved about the shafts 48 toward the cross beam 38 in accordance with the decrease in diameter of the supply roll 2. The shafts 48 each includes resiliently urging means comprising a spring 50 provided thereabout. The springs 50 are engaged at one end with the arms 46 and engaged at the other end with stops 52 to resiliently urge the arms 46 and the roller 44 toward the cross beam 38 so that the roller 44 prevents the supply roll 2 from bouncing from the cross beam 38. The stops 52 are mounted on the side frames 36. Spacers 54 are disposed around the shafts 48 between the springs 50 and the side frames 36.

The shafts 48 are disposed in a position through which the cleaning fabric 6 is fed from the supply roll 2. The device further includes preventing member means comprising a bar 56 which is disposed parallel and adjacent to the shafts 48 between the arms 46 and mounted on the arms 46. Accordingly, the bar 56 narrows the passage of the cleaning fabric 6 when the supply roll 2 decreases in diameter, as shown in FIG. 6(B), for preventing the supply roll 2 from disengaging from the cross beam 38.

Figure 9:
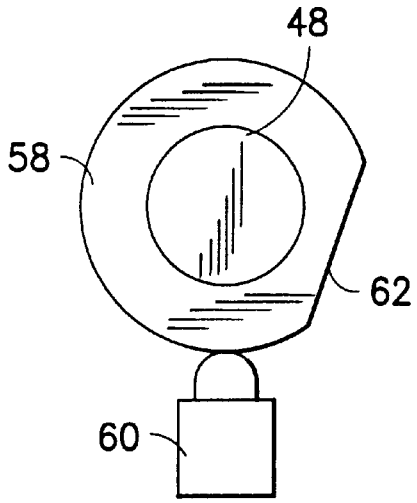
FIG. 9 is an elevational view of the detecting means of FIG. 8.

One of the shafts 48 includes a cam 58 which is opposed to and engaged with detecting means comprising a switch 60. The cam 58 rotates integrally with the shaft 48 and has a cut off surface 62 by which the switch 60 is activated, as shown in FIG. 9. Accordingly, the switch 60 is activated by the rotation of the shaft 48 to detect the residual of the cleaning fabric 6 of the supply roll 2. The switch 60 generates a signal for electrical indication if the residual of the cleaning fabric 6 decreases to a small amount.

Figure 10A:
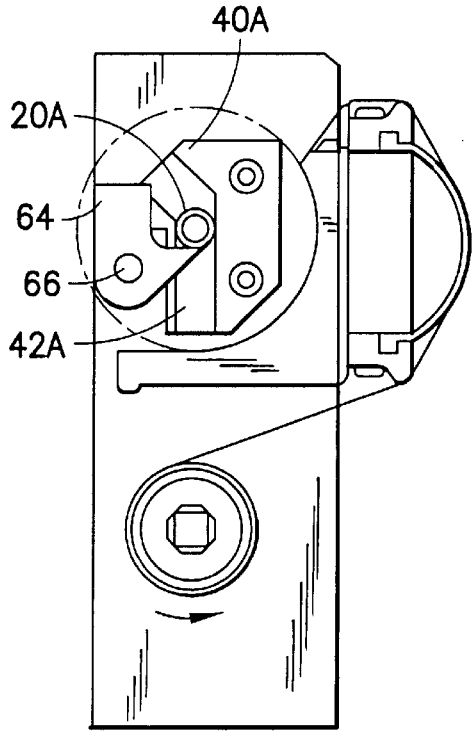
FIG. 10 is a side view of another embodiment.
Figure 10B:
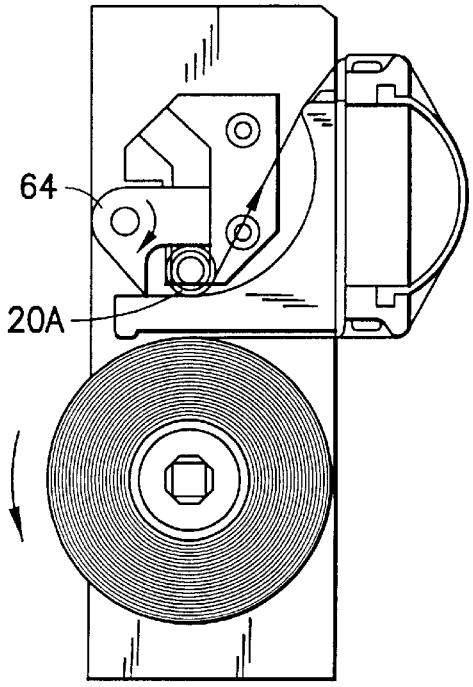

In other embodiment shown in FIG. 10, the projections 20A and 20B are moved along the slots 42A and 42B in the side blocks 40A and 40B which extend downwardly. Movable member means comprises rockers 64 which are fixed to and mounted on shafts 66. Springs are engaged with the shafts 66 to resiliently urge the shaft 66 and the rockers 64 for rotation so that the rockers 64 are engaged with the projections 20A and 20B, as shown in FIG. 10(B).

Figure 11A:
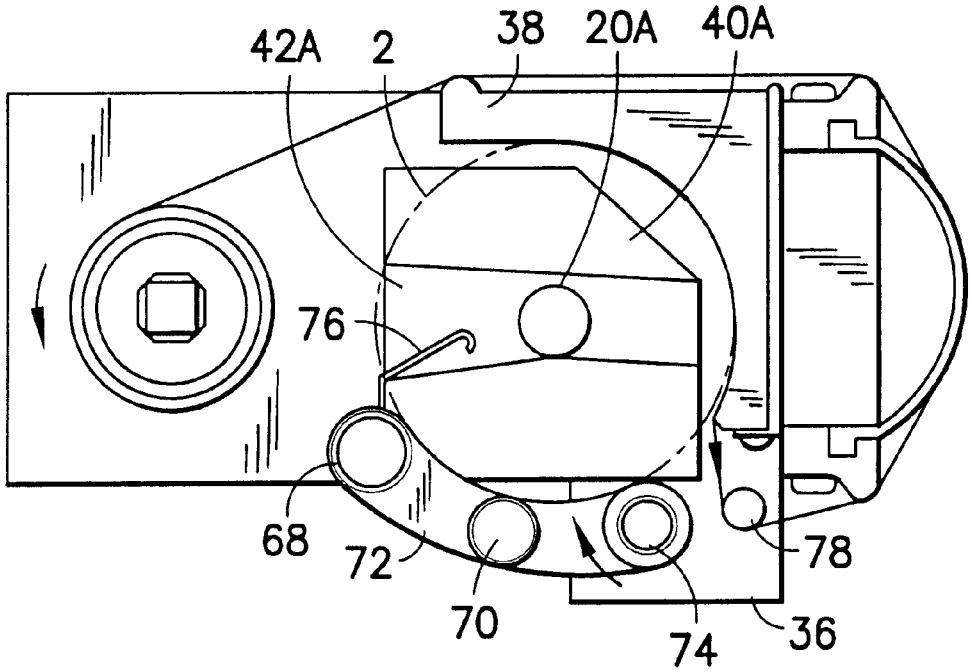
FIG. 11 is a side view of another embodiment.
Figure 11B:
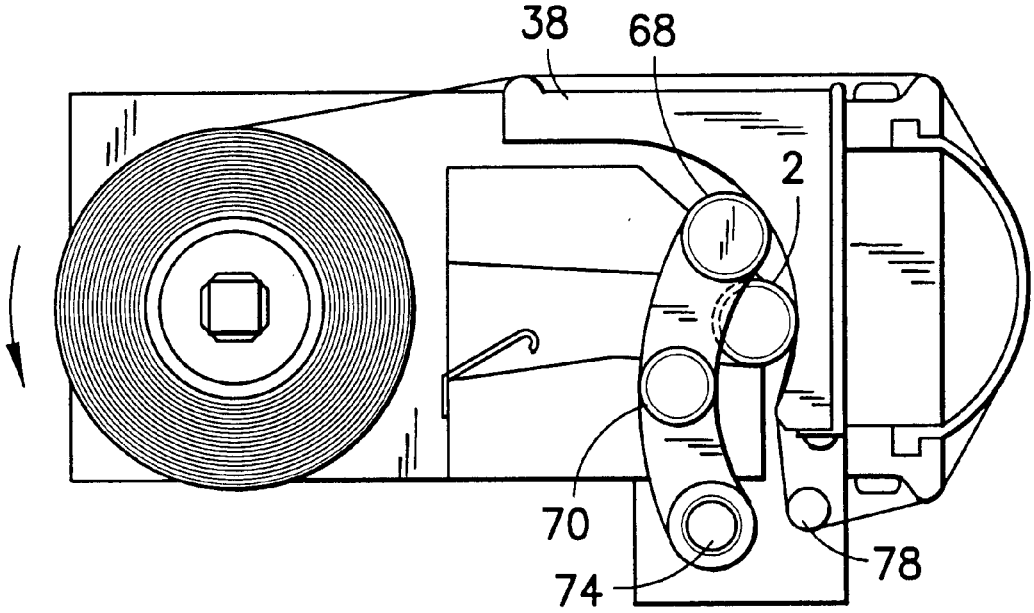

In other embodiment shown in FIG. 11, the stabilizing means comprises movable member means including a pair of rollers 68 and 70 which are opposed to the cross beam 38 and engaged with the outer surface of the supply roll 2. The movable member means further includes a pair of arms 72 which are fixed at one end to shafts 74 extending longitudinally of the supply roll 2. The shafts 74 are mounted on the side frames 36 for rotation so that the arms 72 are supported at one end by the side frames 36 for swingingly movement. The rollers 68 and 70 are disposed between the arms 72, spaced from each other longitudinally of the arms 72 and mounted on the arms 72. Accordingly, the arms 72 and the rollers 68 and 70 can be moved toward the cross beam 38 in accordance with the decrease in diameter of the supply roll 2. In addition, resiliently urging means such as springs are engaged with the shafts 74 for resiliently urging the arms 72 and the rollers 68 and 70 toward the cross beam 38 so that the supply roll 2 is supported on the rollers 68 and 70 for rotation by the resiliently urging means. The rollers 68 and 70 are spaced from each other at a distance slightly larger than the diameter of the core 4. Accordingly, the supply roll 2 is held between the rollers 68 and 70 and the cross beam 38 when the supply roll 2 decreases in diameter, as shown in FIG. 11(B), to prevent the supply roll 2 from vibratingly moving along the cross beam 38 and bouncing from the cross beam 38.

In the device in FIG. 11, the side blocks 40A and 40B each includes the slot 42A and 42B extending horizontally toward the cross beam 38. The slot 42A and 42B includes a resilient preventing member 76 disposed in the opening of the slot 42A and 42B. The preventing member 76 is pushed and deformed by the projection 20A and 20B when the projection 20A and 20B is inserted into the slot 42A and 42B. The preventing member 76 is then restored to the original state to prevent the core 4 from being detached. In addition, a bar 78 is disposed parallel and adjacent to the shaft 74 to form a passage between the shaft 74 and the bar 78 so that the cleaning fabric 6 is fed through the passage from the supply roll 2. The passage has a width less than the diameter of the core 4 to prevent the supply roll 2 from disengaging from the cross beam 38.

Figure 12A:
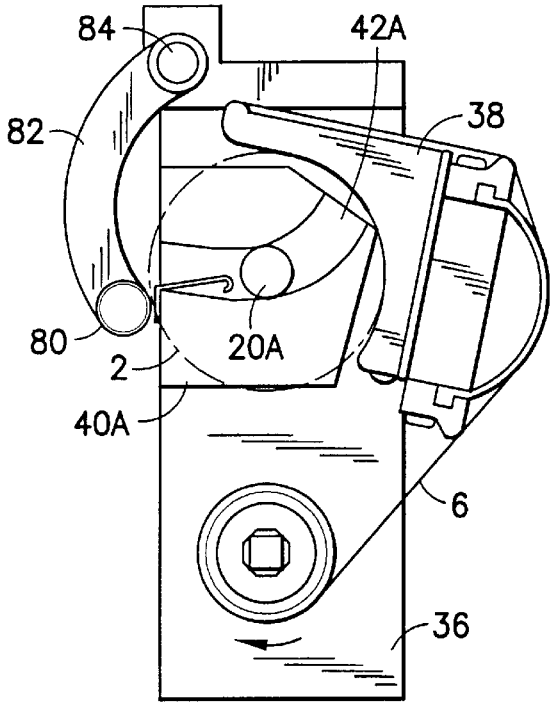
FIG. 12 is a side view of another embodiment.
Figure 12B:
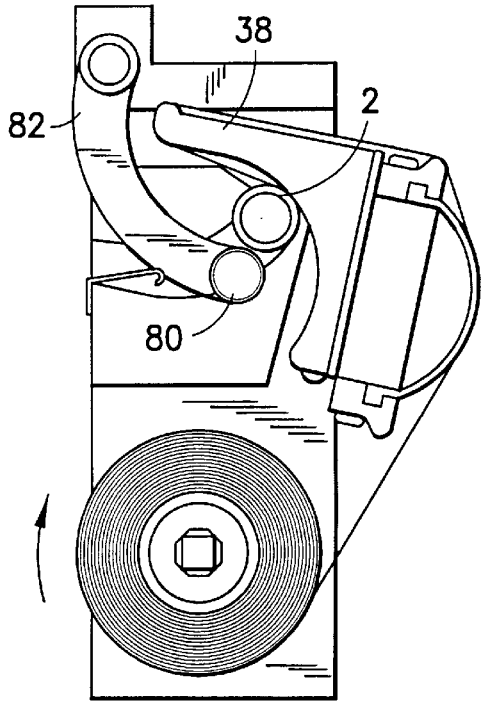

In other embodiment shown in FIG. 12, the stabilizing means comprises movable member means including a roller 80 which are opposed to the cross beam 38 and engaged with the outer surface of the supply roll 2. The movable member means further includes a pair of arms 82 which are fixed at one end to shafts 84 extending longitudinally of the supply roll 2. The shafts 84 are mounted on the side frames 36 for rotation so that the arms 82 are supported at one end by the side frames 36 for swingingly movement. The roller 80 is disposed between and mounted on the arms 82. Accordingly, the arms 82 and the roller 80 can be moved toward the cross beam 38 in accordance with the decrease in diameter of the supply roll 2. In addition, resiliently urging means such as springs are engaged with the shafts 84 for resiliently urging the arms 82 and the roller 80 toward the cross beam 38. The side blocks 40A and 40B each includes the slot 42A and 42B in which the projection 20A and 20B is inserted. The slot 42A and 42B extends along a circular arc centered at the shaft 84 so that the roller 80, the side blocks 40A and 40B and the cross beam 38 cooperate with each other to support the supply roll 2 for rotation. The shaft 84 is disposed parallel and adjacent to the cross beam 38 to form a passage between the cross beam 38 and the shaft 84 so that the cleaning fabric 6 is fed through the passage from the supply roll 2. The passage has a width less than the diameter of the core 4 to prevent the supply roll 2 from disengaging from the cross beam 38 when the supply roll 2 decreases in diameter, as shown in FIG. 12(B).

Figure 13A:
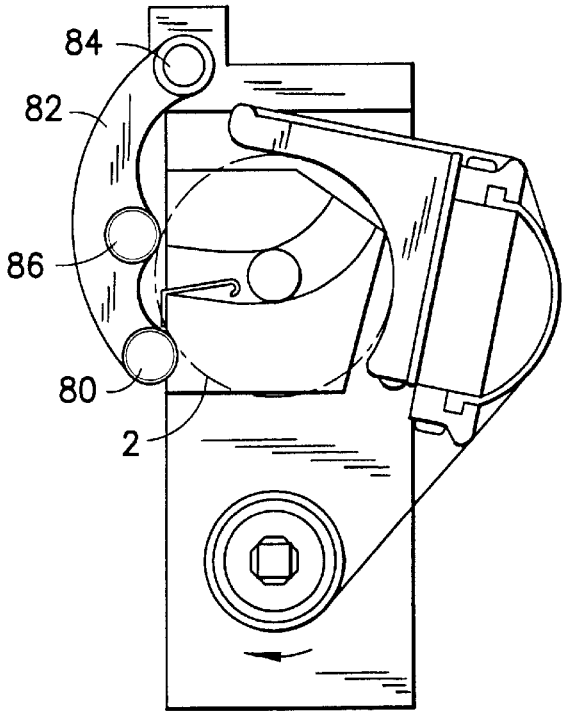
FIG. 13 is a side view of another embodiment.
Figure 13B:
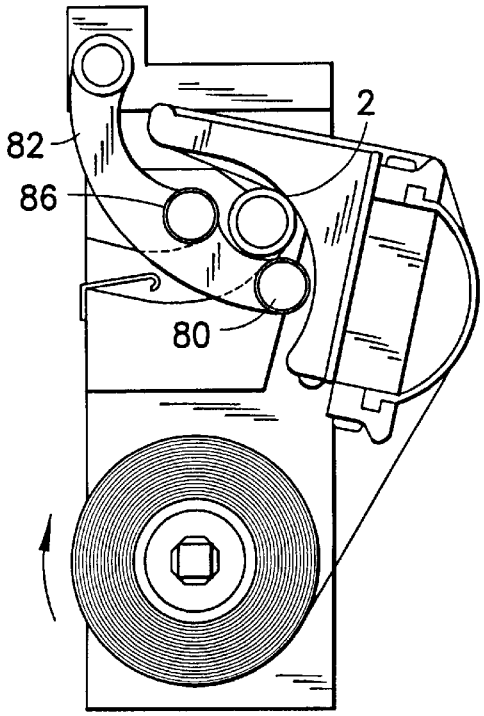

In other embodiment shown in FIG. 13, a pair of rollers 80 and 86 are spaced from each other longitudinally of the arms 82, mounted on the arms 82 and engaged with the outer surface of the supply roll 2. The rollers 80 and 86 are spaced from each other at a distance slightly larger than the diameter of the core 4.

Figure 14A:
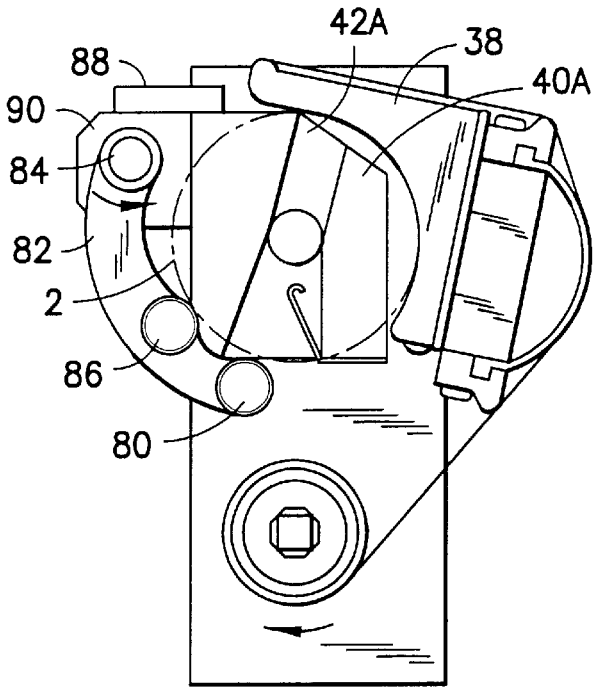
FIG. 14 is a side view of another embodiment.
Figure 14B:
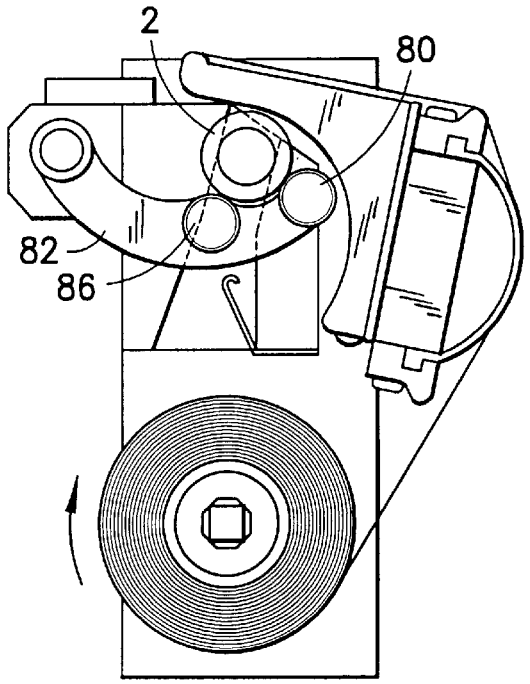

In other embodiment shown in FIG. 14, the slot 42A and 42B extends vertically toward the cross beam 38. The rollers 80 and 86 are engaged with the outer surface of the supply roll 2 to support the supply roll 2 for rotation. A preventing block 88 is disposed adjacent to the cross beam 38 and mounted on a bracket 90 to form a passage through which the cleaning fabric 6 is fed from the supply roll 2. The preventing block 88 prevents the supply roll 2 from disengaging from the cross beam 38.

Figure 15A:
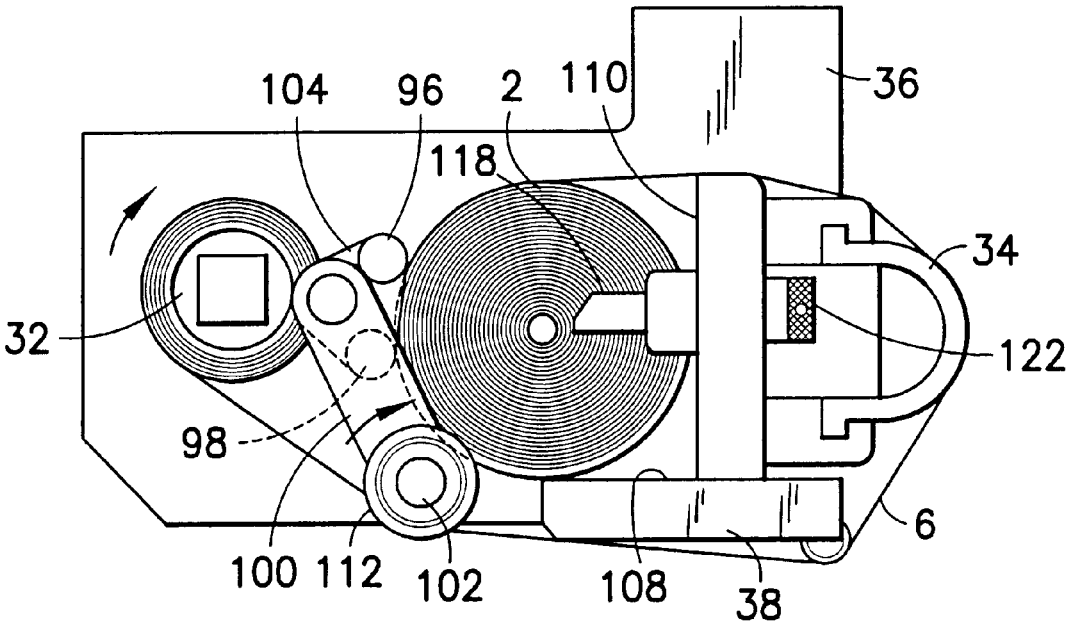
FIG. 15 is a side view of another embodiment.
Figure 15B:
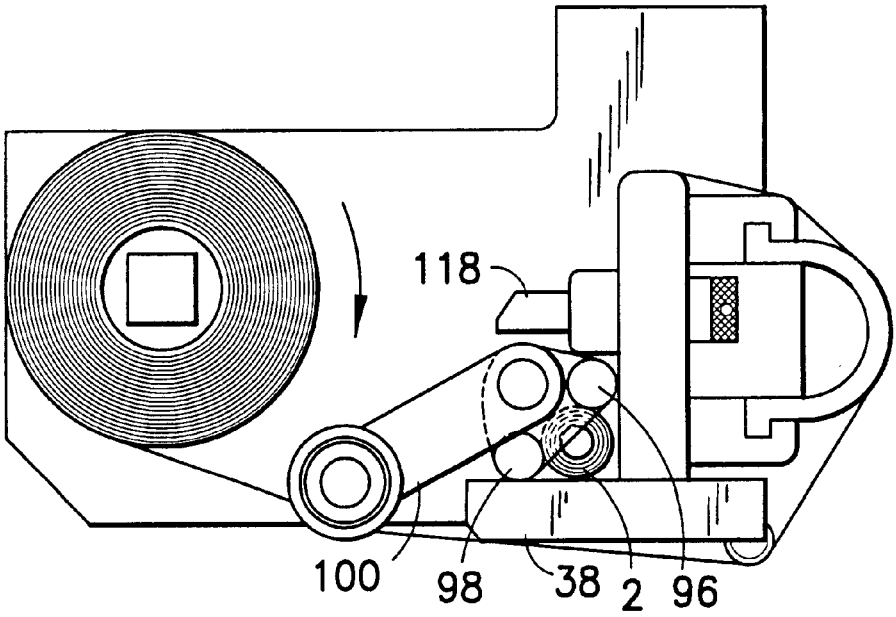
Figure 16:
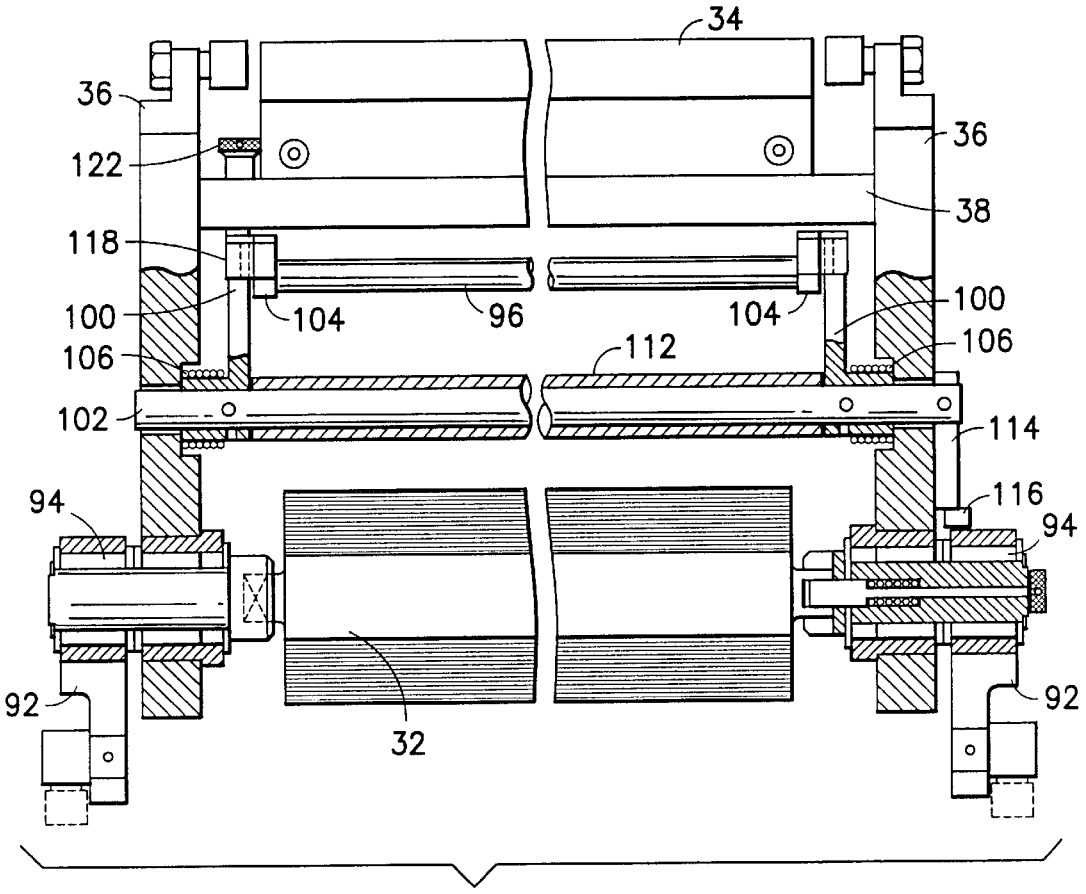
FIG. 16 is a sectional plan view of the device of FIG. 15.

In other embodiment shown in FIG. 15, the take up shaft 32 is rotationally driven by a cylinder which is connected to the take up shaft 32 through a lever 92 and a one-way clutch 94, as shown in FIG. 16, to take up the cleaning fabric 6 about the take up shaft 32. Accordingly, the cleaning fabric 6 is intermittently supplied from the supply roll 2 to the pressure pad 34. The cleaning fabric 6 is then pressed against the outer surface of the cylinder by the pressure pad 34 to clean the outer surface of the cylinder.

As to the cleaning fabric 6 wound on the supply roll 2 in the device in FIG. 15, the cleaning fabric 6 has an outer surface or one surface which is made of pulp and intended to be bought into contact with the outer surface of the cylinder for cleaning, and an inner surface or the other surface which is made of polyester for reinforcing the cleaning fabric 6. The operator properly sets up the supply roll 2 in the device to conveniently supply the cleaning fabric 6 from the supply roll 2 so that the one surface of the cleaning fabric 6 is bought into contact with the outer surface of the cylinder.

In the device in FIG. 15, the stabilizing means is opposed to the cross beam 38 and engaged with the outer surface of the supply roll 2 to sandwich and stabilize the supply roll 2 between the stabilizing means and the cross beam 38. The stabilizing means includes a pair of engaged members 96, and 98 spaced from each other circumferentially of the supply roll 2 and engaged with the outer surface of the supply roll 2. A pair of arms 100 are supported at ends on a shaft 102, the engaged members 96 and 98 being each disposed between and mounted on a pair of plates 104 which are mounted on the other ends of the arms 100 for swinging movement. The stabilizing means further includes resiliently urging means such as springs 106 for resiliently urging the arms 100 to press the engaged members 96 and 98 against the outer surface of the supply roll 2. The engaged members 96 and 98 each comprises a rotatable roller. The engaged members 96 and 98 may each comprise a non-rotatable roller.

In the device in FIG. 15, the cross beam 38 has a horizontal surface 108 and a vertical surface 110. The vertical surface 110 extends upwardly of the horizontal surface 108. The shaft 102 extends parallel to the vertical surface 110 and includes a sleeve 112 fitted onto the outer surface thereof. The sleeve 112 has a portion disposed slightly upwardly of the horizontal surface 108. Accordingly, the outer surface of the supply roll 2 can be engaged with and supported on the vertical surface 110, the horizontal surface 108 and the portion of the sleeve 112 when the arms 100 are manipulated by an operator and swingingly moved about the shaft 102 in a counterclockwise direction in FIG. 15, in the first place.

The shaft 102 includes a lever 114 fixed to and rotated integrally with the one end thereof for activating a switch 116. The lever 114 cooperates with the switch 116 to detect the residual of the cleaning fabric 6 of the supply roll 2.

Figure 17:
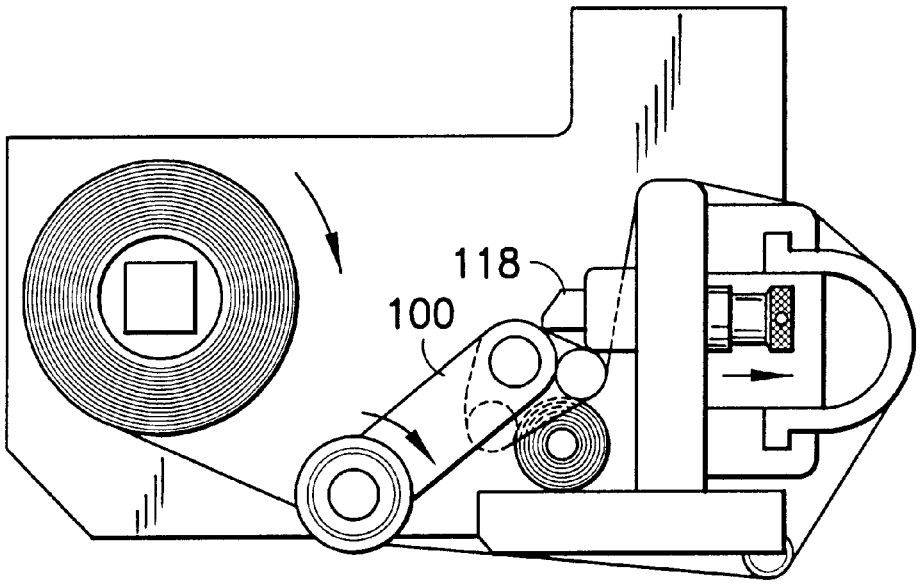
FIG. 17 is a side view showing a rod retracted from a path along which an arm is swingingly moved in FIG. 15.
Figure 18:
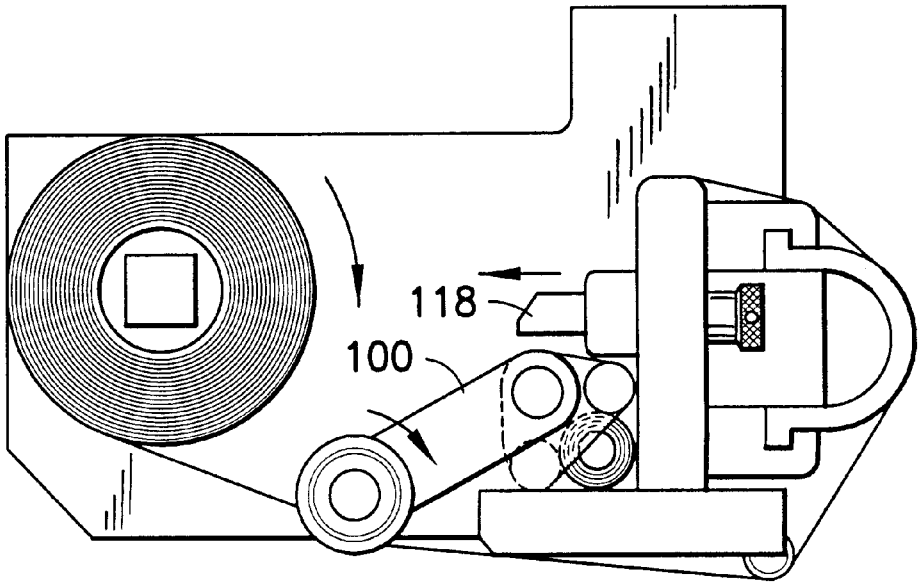
FIG. 18 is a side view showing the rod advanced into the path in FIG. 17.
Figure 19:
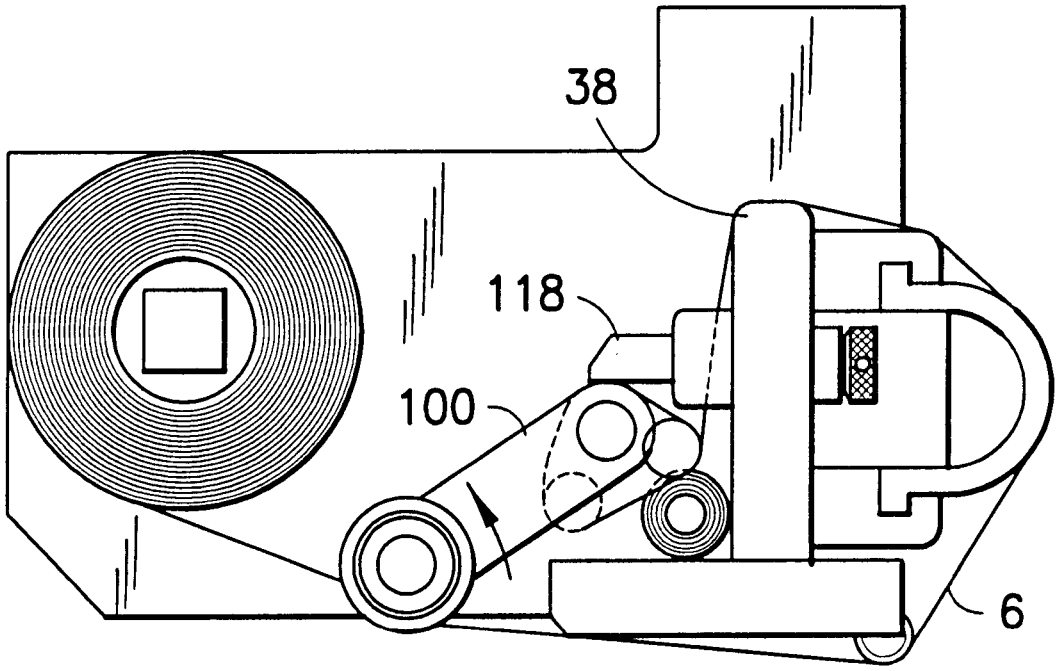
FIG. 19 is a side view showing the rod preventing the arm from reversely moving in FIG. 18.

In addition, the device further includes preventing means for preventing the arms 100 from reversingly moving to prevent the supply roll 2 from disengaging from the cross beam 38. The preventing means comprises a rod 118 axially movable to be advanced into and retracted from a path along which one of the arms 100 is swingingly moved. The arm 100 is bought into contact with the rod 118 to retract the rod 118 from the path when the arm 100 is swingingly moved toward the cross beam 38 in accordance with the decrease in diameter of the supply roll 2, as shown in FIG. 17. The preventing means further includes resiliently urging means such as a spring for resiliently urging the rod 118 to advance the rod 118 into the path after the arm 100 passes through the rod 118, as shown in FIG. 18. The rod 118 then prevents the arm 110 from reversingly moving, as shown in FIG. 19, so that the roller 96 prevents the supply roll 2 from disengaging from the cross beam 38.

The rod 118 can be retracted by knob 122 to reversely move the arm 100.

Figure 20A:
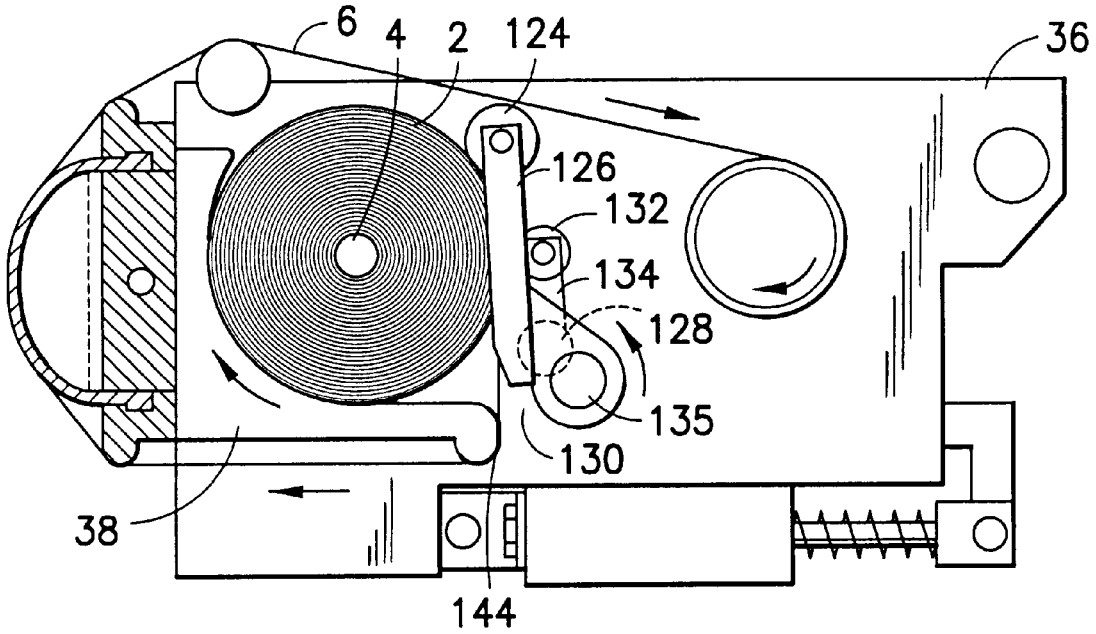
FIG. 20 is a side view of another embodiment.

In other embodiment shown in FIG. 20, the outer surface of the supply roll 2 is engaged with and received by the cross beam 38 mounted on the side frames 36. The stabilizing means includes a first elongated member 124 opposed to the cross beam 38, mounted and supported on arms 126 and engaged with the outer surface of the supply roll 2. The arms 126 include a bar 128 disposed between and mounted on the arms 126. The bar 128 extends parallel to the cross beam 38, a passage 130 being formed between the cross beam 38 and the bar 128 so that the cleaning fabric 6 is fed through the passage 130 from the supply roll 2. The stabilizing means further includes a second elongated member 132 disposed between the first elongated member 124 and the bar 128. The second elongated member 132 is disposed between and mounted on additional arms 134 which are supported on the bar 128. The first and second elongated members 124 and 132 comprise rotatable or non-rotatable rollers.

Figure 21:
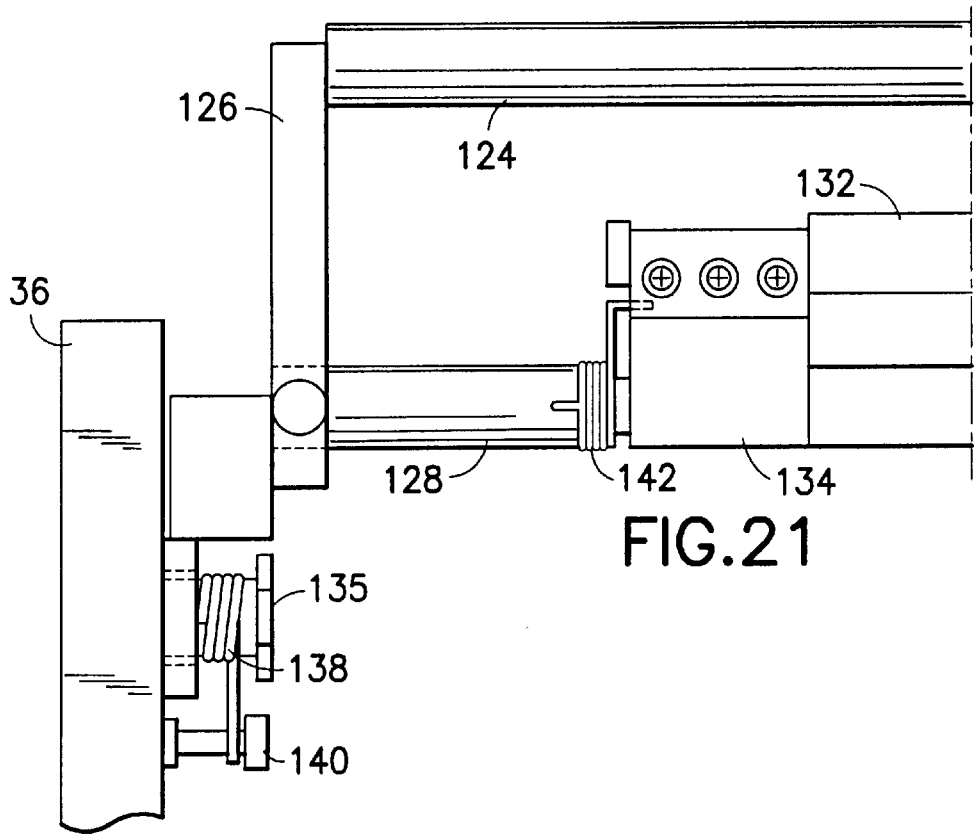
FIG. 21 is an elevational view of one half of the device of FIG. 20.
Figure 22:
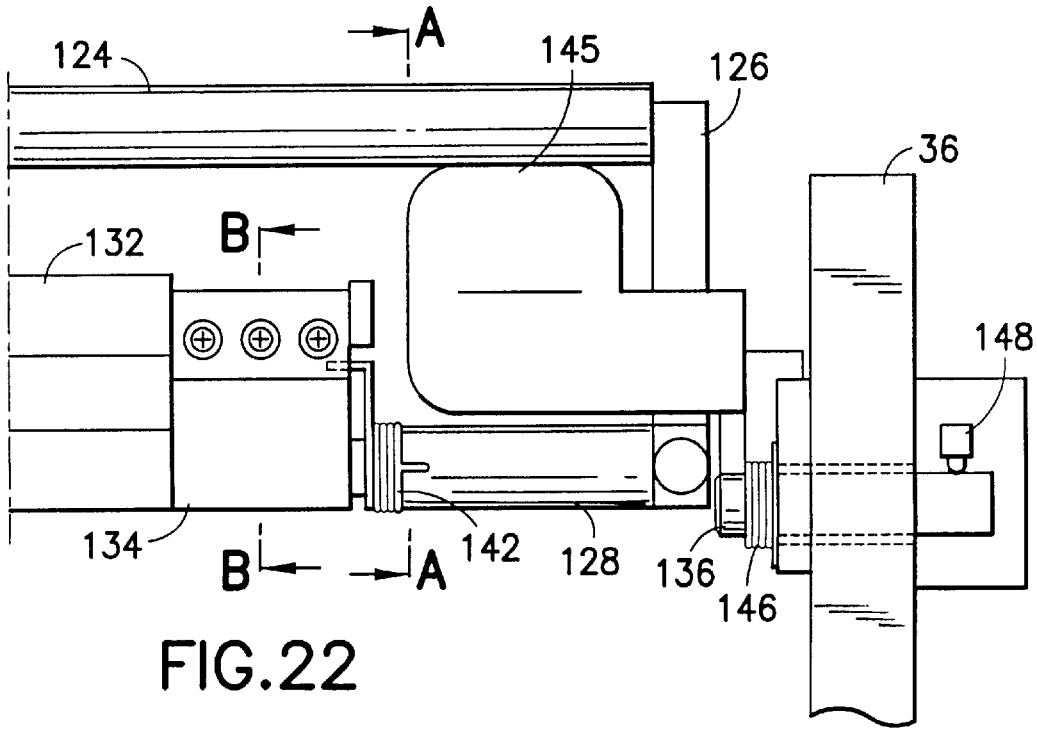
FIG. 22 is an elevational view of the other half of the device of FIG. 20.
Figure 23:
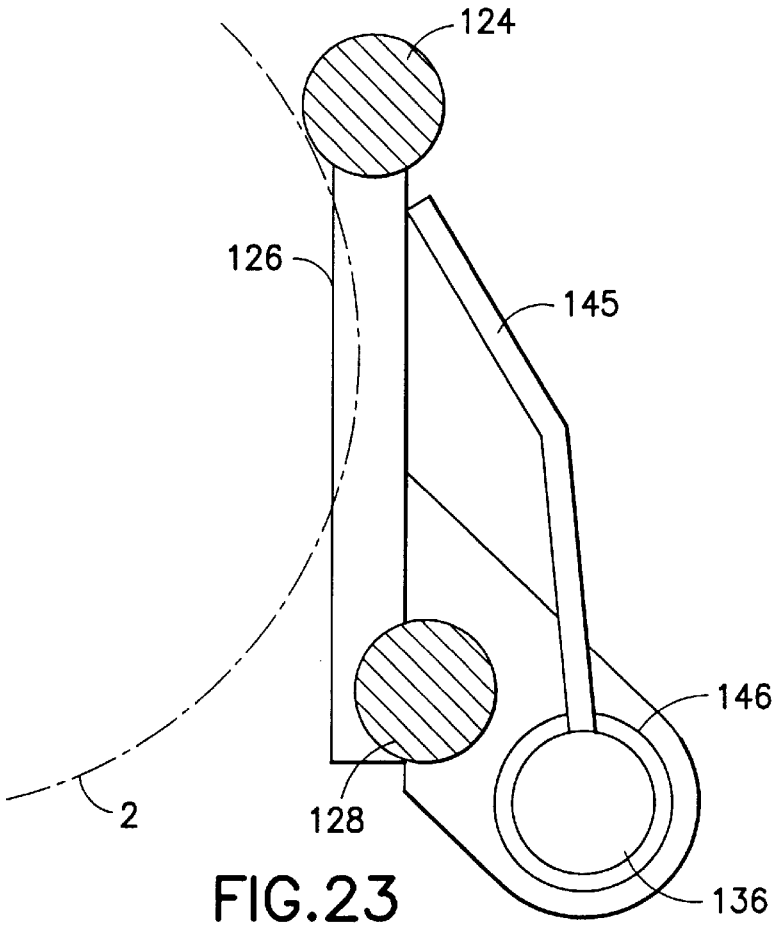
FIG. 23 is a sectional view taken along line A—A in FIG. 22.
Figure 24:
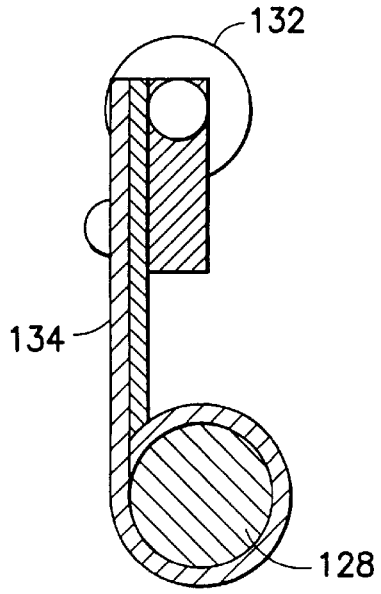
FIG. 24 is a sectional view taken along line B—B in FIG. 22.

The arms 126 are supported at one ends for swingingly movement to move the first elongated member 124 toward the cross beam 38 in accordance with the decrease in diameter of the supply roll 2. In the embodiment, the arms 126 are supported by and swingingly moved about a support pin 135 and a shaft 136 which are mounted on the side frames 36, as shown in FIG. 21 and FIG. 22. The additional arms 134 can be swingingly moved about the bar 128 toward the supply roll 2 so that the second elongated member 132 is engaged with the outer surface of the supply roll 2. A spring 138 is disposed about the support pin 135 and engaged at opposite ends with the arm 126 and an additional pin 140 which is mounted on the side frame 36, for resiliently urging the first elongated member 124 toward the cross beam 38. In addition, springs 142 are disposed about the bar 128 and engaged at one ends with the additional arms 134 for resiliently urging the second elongated member 132 toward the supply roll 2.

The support pin 135 is disposed adjacent to one edge 144 of the cross beam 38. The bar 128 is positioned on the cross beam side of a plane extending through the first elongated member 124 and the support pin 135 so that the passage 130 decreases in width between the cross beam 38 and the bar 128 in accordance with the decrease in diameter of the supply roll 2. The passage 130 decreases in width between the cross beam 38 and the bar 128 to be maintained less than the decreasing diameter of the supply roll 2 so that the bar 128 prevents the supply roll 2 from disengaging from the cross beam 38.

Figure 20B:
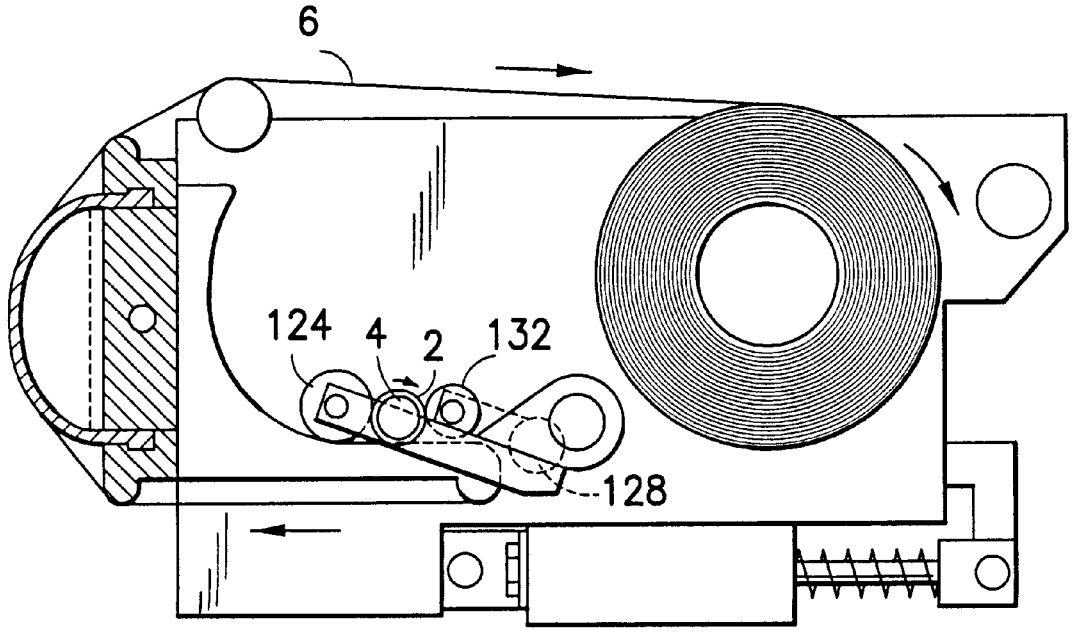

The supply roll 2 includes a core 4 about which the cleaning fabric 6 is wound. The core 6 is positioned between a circular arc path along which the first elongated member 124 is moved and a circular arc path along which the second elongated member 132 is moved so that the supply roll 2 is held between the first elongated member 124 and the second elongated member 132, as shown in FIG. 20(B). The second elongated member 132 is interposed between the passage 130 and the supply roll 2.

The device further includes detecting means comprising a detecting plate 145 which is fixed to the shaft 136. A spring 146 resiliently urges the detecting plate 145 toward the supply roll 2 so that the detecting plate 145 is engaged with the outer surface of the supply roll 2. The shaft 136 is rotated integrally with the detecting plate 145 in accordance with the decrease in diameter of the supply roll 2 so that a switch 148 is activated by the rotation of the shaft 136 for detecting the end of the cleaning fabric 6 from the supply roll 2.

Figure 25:
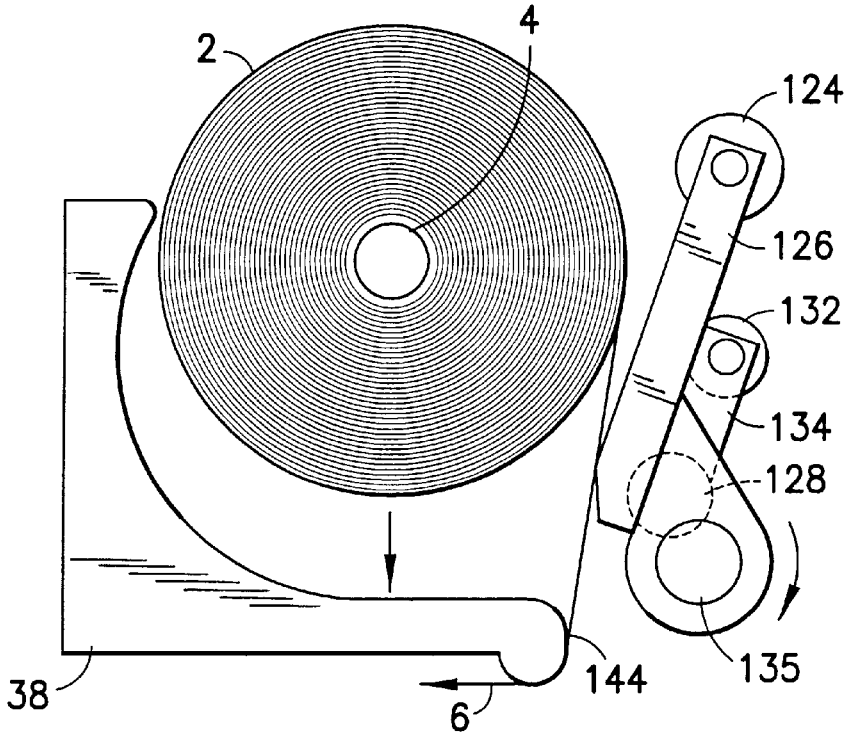
FIG. 25 is a side view of a cleaning fabric supply roll of FIG. 20 which is being set up in the device.
Figure 26:
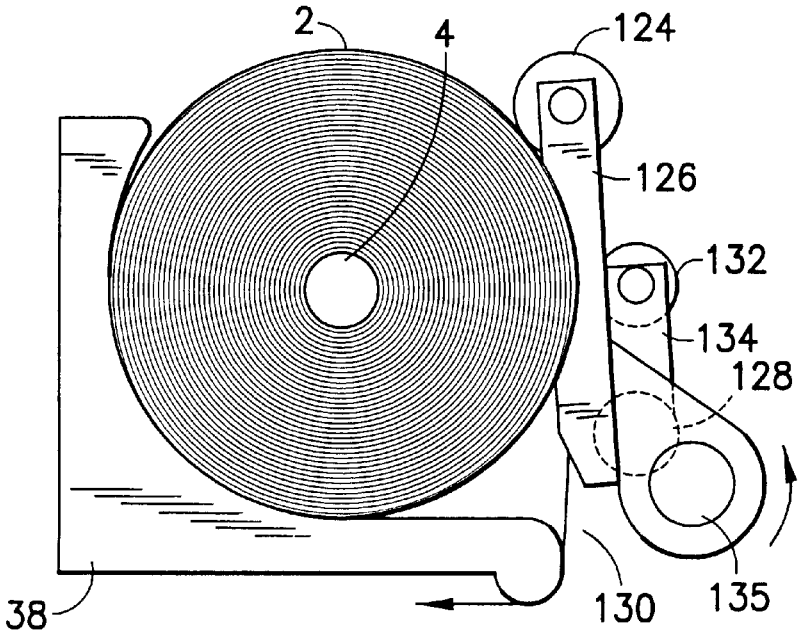
FIG. 26 is a side view of the supply roll of FIG. 25 which has been set up in the device.
Figure 27:
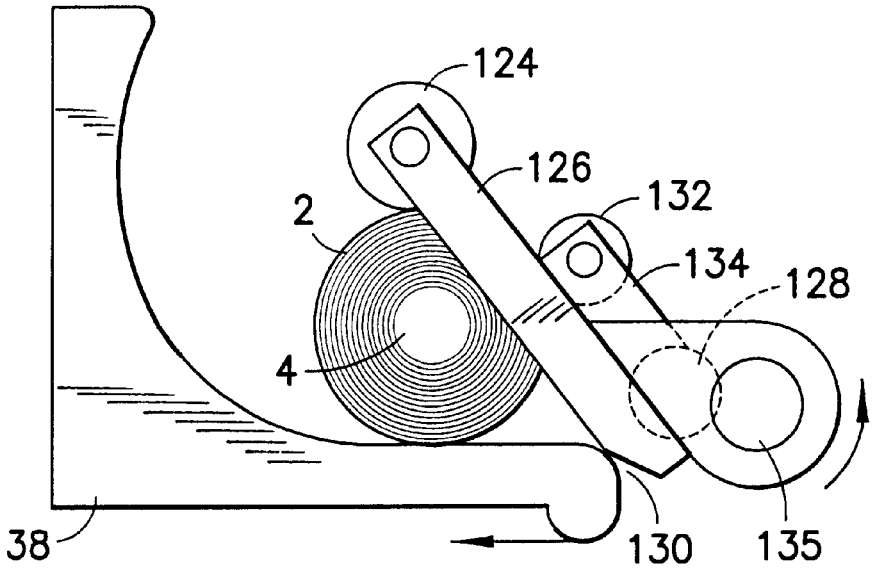
FIG. 27 is a side view of the supply roll of FIG. 26 having a diameter decreasing.
Figure 28:
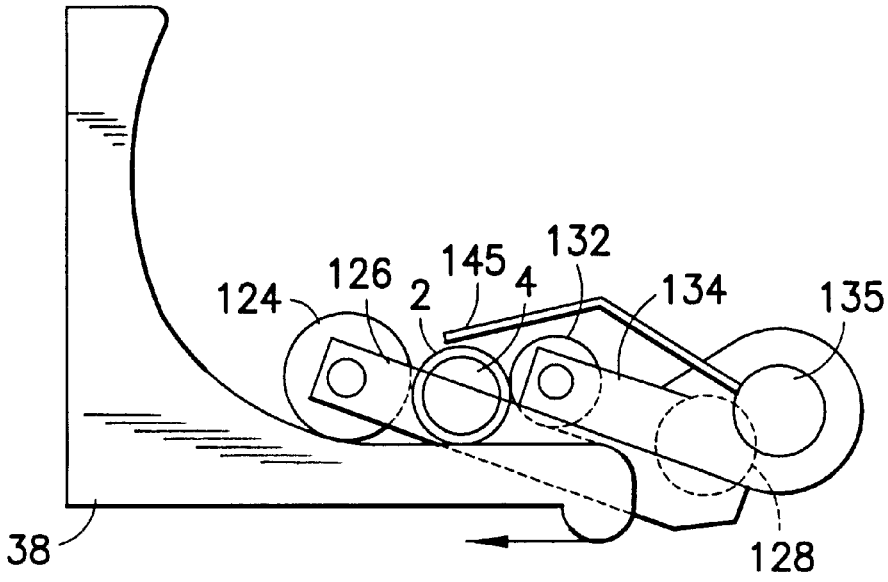
FIG. 28 is a side view of the supply roll of FIG. 27 having the diameter more decreasing.

In the device in FIG. 20, the arms 126 are manipulated by an operator so that the outer surface of the supply roll 2 can be engaged with the cross beam 38, as shown in FIG. 25. The arms 126 are then swingingly moved about the support pin 135 by the spring 138 so that the first and second elongated members 124 and 132 are engaged with the outer surface of the supply roll 2, as shown in FIG. 26. The first and second elongated members 124 and 132 are then moved toward the cross beam 38 in accordance with the decrease in diameter of the supply roll 2, as shown in FIG. 27 and FIG. 28.

Figure 29:
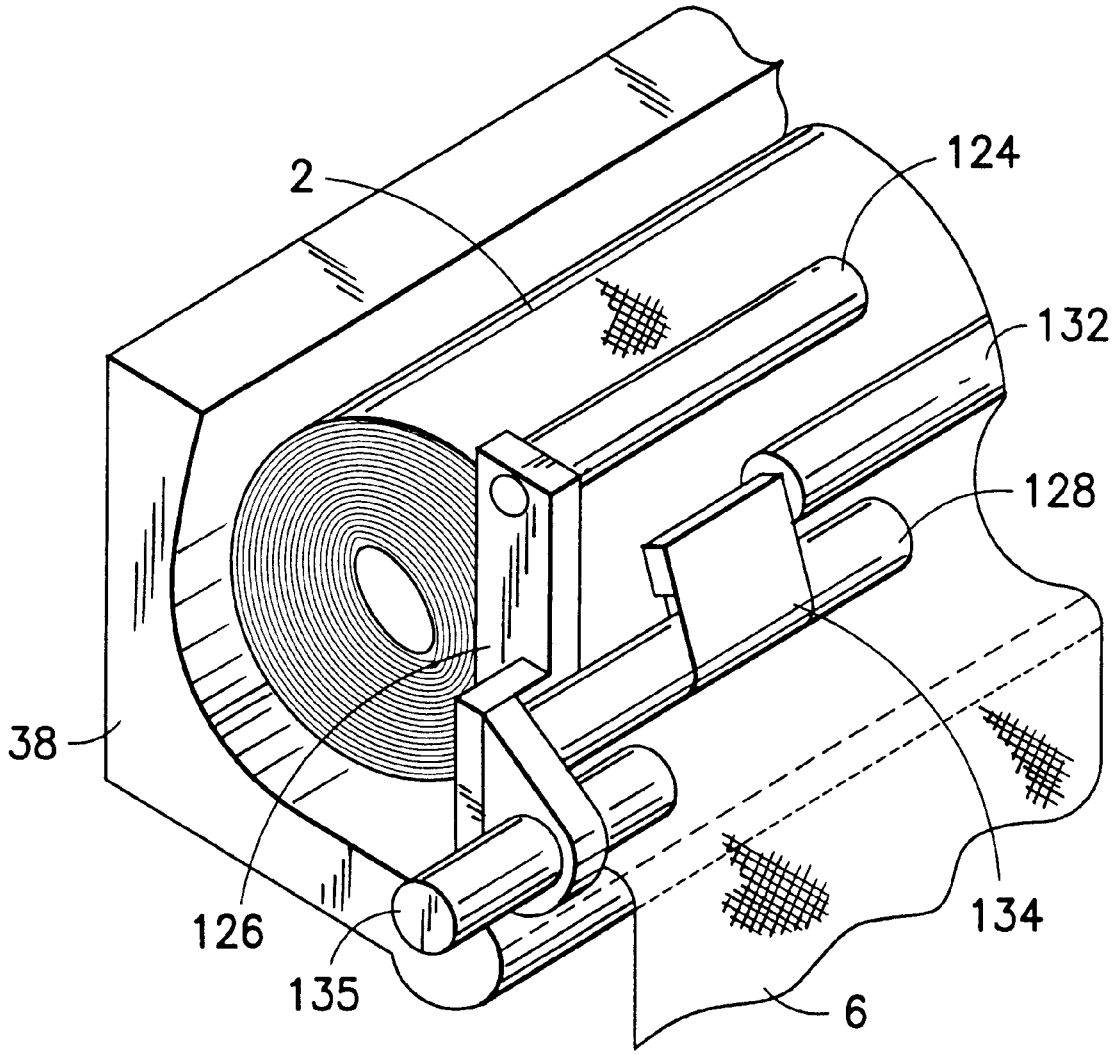
FIG. 29 is a perspective view of another embodiment.

The first elongated member 124 may be shorten than the supply roll 2 and supported at only one end by the arm 126, as shown in FIG. 29. The bar 128 may be divided into two parts which are shorten than the supply roll 2 and supported at only one ends by the arms 126 respectively.

What is claimed is:

1. A cylinder cleaning device for use with a supply roll having a diameter, said supply roll including a cleaning fabric wound thereon to form an outer surface, said cleaning fabric being supplied from said supply roll to a cylinder which has an outer surface, said cleaning fabric being pressed against said outer surface of the cylinder to clean said outer surface of the cylinder, the device comprising:

frame;

roll receiving means mounted on said frame, said outer surface of the supply roll being engaged with and received by the receiving means; and roll stabilizing means for stabilizing said supply roll on said receiving means when said supply roll is rotated on said receiving means to supply said cleaning fabric, said stabilizing means being opposed to said roll receiving means and engaged with said outer surface of the supply roll to sandwich and stabilize said supply roll between said stabilizing means and said roll receiving means.

2. The device of claim 1 wherein said receiving means comprises a cross beam mounted on said frame, the outer surface of said supply roll being engaged with and received by said cross beam to support said supply roll for rotation, said stabilizing means comprising a plurality of engaged members spaced from each other circumferentially of said supply roll and engaged with the outer surface of said supply roll, and mounting and moving means for mounting said engaged members thereon and swingingly moving said engaged members toward said cross beam in accordance with the decrease in diameter of said supply roll.

3. The device of claim 2 wherein said mounting and moving means comprises arm means supported at one end on shaft means, plate means mounted on the other end of said arm means for swinging movement, said engaged members being mounted on said plate means, and resiliently urging means for resiliently urging said arm means to press said engaged members against the outer surface of said supply roll.

4. The device of claim 3 wherein said cross beam has a horizontal surface and a vertical surface, said vertical surface extending upwardly of said horizontal surface, said shaft means extending parallel to said vertical surface and having a portion disposed slightly upwardly of said horizontal surface, the outer surface of said supply roll being engaged with and supported on said vertical surface.

5. The device of claim 3 further comprising preventing means for preventing said arms means from reversely moving to prevent said supply roll from disengaging from said cross beam.

6. The device of claim 5 wherein said preventing means comprises rod means axially movable to be advanced into and retracted from a path along which said arm means is swingingly moved, said arm means being brought into contact with said rod means to retract said rod means from said path when said arm means is swingingly moved toward said cross beam in accordance with the decrease in diameter of said supply roll, and resiliently urging means for resiliently urging said rod means to advance it into said path after said arm means passes through said rod to prevent said arm means from reversely moving.

7. The device of claim 2 wherein said engaged members each comprises a rotatable roller.

8. The device of claim 2 wherein said engaged members each comprises a non-rotatable roller.

9. The device of claim 1 wherein said frame comprises a pair of side frames, said receiving means comprising a cross beam disposed between and mounted on said side frames, said outer surface of said supply roll being engaged with and received by said cross beam to support said supply roll for rotation, said stabilizing means being opposed to said cross beam, mounted to arm means and engaged with the outer surface of said supply roll, said arm means being supported at one end for swinging movement to move said stabilizing means toward said cross beam in accordance with the decrease in diameter of said supply roll, said arm means including bar means mounted thereon and extending parallel to said cross beam, a passage being formed between said cross beam and said bar means so that said cleaning fabric is fed through said passage form said supply roll.

10. The device of claim 9 wherein said stabilizing means comprises a first elongated member supported on said arm means and a second elongated member disposed between said first elongated member and said bar means, said second elongated member being mounted on additional arm means supported on said bar means, said additional arm means being swingingly moved about said bar means toward said supply roll so that said second elongated member is engaged with the outer surface of said supply roll.

11. The device of claim 10 wherein said arm means is supported by and swingingly moved about support means which is disposed adjacent to one edge of said cross beam, said bar means being positioned on the cross beam side of a plane extending through said first elongated member, said cross beam and said bar means in accordance with the decrease in diameter of said supply roll.

12. The device of claim 11 wherein said passage decreases in width between said cross beam and said bar means to be maintained less than the decreasing diameter of said supply roll.

13. The device of claim 12 wherein said second elongated member is interposed between said passage and said supply roll.

14. The device of claim 1 wherein said frame comprises a pair of side frames, said receiving means comprising a cross beam disposed between and mounted on said side frames, said outer surface of said supply roll being engaged with and received by said cross beam to support said supply roll, said stabilizing means being opposed to said cross beam, mounted on arm means and engaged with the outer surface of said supply roll, said arm means being supported at one end for swinging movement to move said stabilizing means upward said cross beam in accordance with the decrease in diameter of said supply roll, said arm means including bar means mounted thereon and extending parallel to said cross beam, a passage being formed between said cross beam and said bar means so that said cleaning fabric is fed through said passage from said supply roll, said stabilizing means comprising a first elongated member supported on said arms means and a second elongated member disposed between said first elongated member and said bar means, said second elongated member being mounted on additional arm means supported on said bar means, said additional arm means being swingingly moved about said bar means toward said supply roll so that said second elongated member is engaged with the outer surface of said supply roll.

15. The device of claim 14 wherein said supply roll has a core about which said cleaning fabric is wound, said core being positioned between a circular arc path along which said first elongated member is moved and a circular arc path along which said second elongated member is moved.

16. The device of claim 15 further comprising detecting means for detecting the end of said cleaning fabric from said supply roll.

* * * * *